US009462904B2

(12) United States Patent
Coon et al.

(10) Patent No.: US 9,462,904 B2
(45) Date of Patent: Oct. 11, 2016

(54) TRAVEL BEVERAGE CONTAINER

(71) Applicant: IGNITE USA, LLC, Chicago, IL (US)

(72) Inventors: Robert Coon, Chicago, IL (US); Paul Hurley, Libertyville, IL (US)

(73) Assignee: IGNITE USA, LLC, Chicago, IL (US)

( * ) Notice: Subject to any disclaimer, the term of this patent is extended or adjusted under 35 U.S.C. 154(b) by 11 days.

(21) Appl. No.: 14/476,240

(22) Filed: Sep. 3, 2014

(65) Prior Publication Data

US 2015/0060448 A1 Mar. 5, 2015

Related U.S. Application Data

(60) Provisional application No. 61/873,084, filed on Sep. 3, 2013.

(51) Int. Cl.

| | |
|---|---|
| ***A47G 19/22*** | (2006.01) |
| ***B65D 43/26*** | (2006.01) |
| ***A45F 3/18*** | (2006.01) |
| *B65D 43/02* | (2006.01) |

(52) U.S. Cl.

CPC ..... *A47G 19/2272* (2013.01); *A45F 3/18* (2013.01); *B65D 43/265* (2013.01); *B65D 43/0225* (2013.01); *B65D 2251/0003* (2013.01); *B65D 2251/20* (2013.01)

(58) Field of Classification Search

CPC ..... A47G 19/2266; A47G 19/2272; B65D 2251/20; B65D 43/00; B65D 43/02; B65D 43/0202; B65D 43/0225; B65D 43/26; B65D 43/265; B65D 43/267; B65D 51/16; B65D 51/1672; B65D 51/1683; B65D 51/007; B65D 51/18

USPC ..... 220/254.1, 254.3, 254.5

See application file for complete search history.

(56) References Cited

U.S. PATENT DOCUMENTS

| | | | |
|---|---|---|---|
| 830,142 | A | 9/1906 | Ebbing |
| 1,072,588 | A | 9/1913 | Duncan |
| 2,193,232 | A | 3/1940 | Hacmac |

(Continued)

FOREIGN PATENT DOCUMENTS

| | | |
|---|---|---|
| JP | 2005193944 | 7/2005 |
| WO | 2005/115204 | 12/2005 |

OTHER PUBLICATIONS

International Search Report for related International Patent Application No. PCT/US14/53887, mailed Dec. 18, 2014.

*Primary Examiner* — Anthony Stashick
*Assistant Examiner* — Mollie Llewellyn
(74) *Attorney, Agent, or Firm* — Marshall, Gerstein & Borun LLP

(57) ABSTRACT

A cleanable lid assembly is provided for a beverage container. The lid assembly has a lid housing having a drink aperture, and a seal assembly that is connected to the lid housing while movable between a first or operable position and a second or cleaning position. The seal assembly has a stopper that can open and close the drink aperture in the first position. The seal assembly is pivotally connected to the lid housing to transition to the cleaning position. A locking member extends transversely from the seal assembly to engage a stop on the lid housing and lock the seal assembly in the operable position. The locking member is moveable radially inward to disengage from the stop and to allow the seal assembly to transition from the first position to the cleaning position.

21 Claims, 12 Drawing Sheets

(56) References Cited

U.S. PATENT DOCUMENTS

| | | | |
|---|---|---|---|
| 2,447,870 | A | 8/1948 | Polcyn |
| 2,622,420 | A | 12/1952 | Rice |
| 2,799,437 | A | 7/1957 | Jepson |
| 3,059,816 | A | 10/1962 | Goldstein |
| D209,483 | S | 12/1967 | Frank |
| 3,635,380 | A | 1/1972 | Fitzgerald |
| 3,739,938 | A | 6/1973 | Paz |
| 3,964,631 | A | 6/1976 | Albert |
| 3,967,748 | A | 7/1976 | Albert |
| 3,972,443 | A | 8/1976 | Albert |
| 4,094,433 | A | 6/1978 | Numbers |
| 4,099,642 | A | 7/1978 | Nergard |
| 4,133,446 | A | 1/1979 | Albert |
| 4,136,799 | A | 1/1979 | Albert |
| 4,171,060 | A | 10/1979 | Howard et al. |
| 4,212,408 | A | 7/1980 | Valenzona |
| 4,276,992 | A | 7/1981 | Susich |
| 4,303,173 | A | 12/1981 | Nergard |
| D288,667 | S | 3/1987 | Miner |
| D291,537 | S | 8/1987 | Crawford et al. |
| 4,686,725 | A | 8/1987 | Mitchell |
| 4,706,313 | A | 11/1987 | Murphy |
| 4,711,372 | A | 12/1987 | Gach |
| 4,712,704 | A | 12/1987 | Ramsey et al. |
| 4,779,766 | A | 10/1988 | Kinsley |
| 4,801,053 | A | 1/1989 | Kaster |
| 4,881,668 | A | 11/1989 | Kitterman et al. |
| 4,901,387 | A | 2/1990 | Luke |
| D315,872 | S | 4/1991 | Bixler |
| 5,025,519 | A | 6/1991 | Spann et al. |
| 5,039,158 | A | 8/1991 | Maier |
| 5,070,560 | A | 12/1991 | Wilkinson |
| 5,082,134 | A | 1/1992 | Ramsey |
| 5,118,014 | A | 6/1992 | Hestehave et al. |
| 5,153,977 | A | 10/1992 | Toida et al. |
| 5,163,196 | A | 11/1992 | Graebe et al. |
| 5,169,016 | A | 12/1992 | Hinz, Jr. |
| 5,179,742 | A | 1/1993 | Oberle |
| 5,186,353 | A | 2/1993 | Ramsey |
| 5,199,597 | A | 4/1993 | Gladish |
| 5,222,623 | A | 6/1993 | Eger et al. |
| 5,244,113 | A | 9/1993 | Stymiest |
| 5,249,703 | A | 10/1993 | Karp |
| 5,252,278 | A | 10/1993 | Spann et al. |
| 5,307,950 | A | 5/1994 | Li |
| D355,322 | S | 2/1995 | Ackley et al. |
| 5,412,821 | A | 5/1995 | Wilkinson |
| 5,427,271 | A | 6/1995 | Wang |
| 5,461,741 | A | 10/1995 | Graebe |
| 5,462,185 | A | 10/1995 | Walker, III |
| 5,465,866 | A | 11/1995 | Belcastro |
| 5,477,980 | A | 12/1995 | Chaffin |
| 5,485,938 | A | 1/1996 | Boersma |
| D367,611 | S | 3/1996 | Wagner et al. |
| D373,927 | S | 9/1996 | Kramer et al. |
| 5,570,797 | A | 11/1996 | Yeh |
| 5,573,139 | A | 11/1996 | Yeh |
| 5,580,504 | A | 12/1996 | Spann et al. |
| 5,586,346 | A | 12/1996 | Stacy et al. |
| 5,596,781 | A | 1/1997 | Graebe |
| 5,606,754 | A | 3/1997 | Hand et al. |
| 5,630,238 | A | 5/1997 | Weismiller et al. |
| 5,649,331 | A | 7/1997 | Wilkinson et al. |
| 5,652,985 | A | 8/1997 | Wilkinson et al. |
| 5,666,681 | A | 9/1997 | Meyer et al. |
| 5,680,951 | A | 10/1997 | Feltman, III et al. |
| 5,689,845 | A | 11/1997 | Sobieralski |
| D386,948 | S | 12/1997 | Wissinger |
| 5,753,289 | A | 5/1998 | Ness |
| D394,778 | S | 6/1998 | Arns et al. |
| D397,905 | S | 9/1998 | Hsu |
| 5,845,352 | A | 12/1998 | Matsler et al. |
| D404,613 | S | 1/1999 | Hatsumoto et al. |
| D405,011 | S | 2/1999 | DeCoster et al. |
| D406,006 | S | 2/1999 | Hatsumoto et al. |
| D408,221 | S | 4/1999 | Asberg |
| D416,755 | S | 11/1999 | Trombly |
| 5,987,668 | A | 11/1999 | Ackley |
| D417,360 | S | 12/1999 | Bickert et al. |
| 6,010,029 | A | 1/2000 | Wang |
| 6,036,271 | A | 3/2000 | Wilkinson et al. |
| 6,053,474 | A | 4/2000 | Stucke et al. |
| 6,098,834 | A | 8/2000 | Hatsumoto et al. |
| 6,102,244 | A | 8/2000 | Kuwano et al. |
| 6,119,291 | A | 9/2000 | Osborne et al. |
| 6,126,035 | A | 10/2000 | Schaper et al. |
| 6,158,608 | A | 12/2000 | Schlattl |
| RE37,016 | E | 1/2001 | Morano |
| D437,229 | S | 2/2001 | Andrew |
| 6,223,369 | B1 | 5/2001 | Maier et al. |
| 6,276,560 | B1 | 8/2001 | Belcastro |
| D447,693 | S | 9/2001 | Warner et al. |
| 6,324,709 | B1 | 12/2001 | Ikeda et al. |
| 6,351,863 | B1 | 3/2002 | Meyer et al. |
| 6,352,166 | B1 | 3/2002 | Copeland |
| 6,401,990 | B1 | 6/2002 | Walters et al. |
| D460,894 | S | 7/2002 | Ziegenfus et al. |
| 6,443,325 | B1 | 9/2002 | Schaper et al. |
| 6,471,085 | B1 | 10/2002 | Gallo |
| D470,009 | S | 2/2003 | Turchi et al. |
| D471,808 | S | 3/2003 | de Castro Couto |
| 6,557,717 | B1 | 5/2003 | Keck |
| 6,623,080 | B2 | 9/2003 | Clapper |
| 6,644,490 | B2 | 11/2003 | Clarke |
| 6,679,397 | B2 | 1/2004 | Smith et al. |
| 6,701,556 | B2 | 3/2004 | Romano et al. |
| 6,702,137 | B1 | 3/2004 | Kowa et al. |
| 6,732,875 | B2 | 5/2004 | Smith et al. |
| 6,732,876 | B2 | 5/2004 | Belcastro |
| 6,732,964 | B2 | 5/2004 | Couchey |
| 6,763,964 | B1 | 7/2004 | Hurlbut et al. |
| 6,782,574 | B2 | 8/2004 | Totton et al. |
| D500,428 | S | 1/2005 | Ward et al. |
| 6,854,615 | B2 | 2/2005 | von Ronn et al. |
| D502,844 | S | 3/2005 | Roho |
| 6,874,185 | B1 | 4/2005 | Phillips et al. |
| 6,901,617 | B2 | 6/2005 | Sprouse, II et al. |
| D508,185 | S | 8/2005 | Gauss |
| 6,922,863 | B2 | 8/2005 | Giori et al. |
| 6,928,681 | B1 | 8/2005 | Stacy |
| 6,952,852 | B2 | 10/2005 | Reeder et al. |
| 6,976,281 | B2 | 12/2005 | Schunk et al. |
| 6,978,910 | B2 | 12/2005 | Sanders et al. |
| D513,452 | S | 1/2006 | Parve |
| 7,011,227 | B2 | 3/2006 | Ward et al. |
| D522,794 | S | 6/2006 | Imai |
| D523,340 | S | 6/2006 | Westphal |
| 7,073,678 | B1 | 7/2006 | Dibdin et al. |
| D526,898 | S | 8/2006 | Isono et al. |
| D526,899 | S | 8/2006 | Mangin et al. |
| 7,086,107 | B2 | 8/2006 | Ellis et al. |
| D529,379 | S | 10/2006 | Mengeu et al. |
| D529,761 | S | 10/2006 | Trombly |
| D533,064 | S | 12/2006 | Glynn et al. |
| 7,195,137 | B2 | 3/2007 | Belcastro |
| D540,625 | S | 4/2007 | Sandberg |
| 7,201,288 | B2 | 4/2007 | von Ronn et al. |
| D541,572 | S | 5/2007 | Watanabe |
| D544,300 | S | 6/2007 | Tien |
| 7,229,134 | B2 | 6/2007 | Ito |
| D547,122 | S | 7/2007 | Gluck |
| D547,611 | S | 7/2007 | Seum et al. |
| D548,008 | S | 8/2007 | Lin |
| D548,508 | S | 8/2007 | Tonelli |
| D552,990 | S | 10/2007 | Vogel |
| D554,433 | S | 11/2007 | Gluck |
| D554,992 | S | 11/2007 | Mangin et al. |
| D555,000 | S | 11/2007 | Bunce et al. |
| D555,514 | S | 11/2007 | Munn |
| D555,970 | S | 11/2007 | Schreitmueller et al. |
| D558,111 | S | 12/2007 | Banks, III |
| D560,435 | S | 1/2008 | Meehan |
| D564,840 | S | 3/2008 | Williams |
| D564,841 | S | 3/2008 | Clemens et al. |

(56) References Cited

U.S. PATENT DOCUMENTS

| | | | |
|---|---|---|---|
| D564,874 | S | 3/2008 | Mangin et al. |
| D569,182 | S | 5/2008 | Homma |
| D572,531 | S | 7/2008 | Romandy et al. |
| D573,404 | S | 7/2008 | Wahl |
| 7,413,096 | B2 | 8/2008 | Morgan et al. |
| D577,582 | S | 9/2008 | Walsh et al. |
| D577,958 | S | 10/2008 | Homma |
| D581,727 | S | 12/2008 | Pinelli et al. |
| D584,107 | S | 1/2009 | George |
| D587,060 | S | 2/2009 | Tong Chi Chung |
| D587,969 | S | 3/2009 | Gilbert |
| D588,411 | S | 3/2009 | Watanabe |
| D589,750 | S | 4/2009 | Liu et al. |
| 7,513,380 | B2 | 4/2009 | Canedo |
| D592,012 | S | 5/2009 | Carreno |
| D592,456 | S | 5/2009 | Pinelli |
| D592,905 | S | 5/2009 | Pinelli |
| D592,913 | S | 5/2009 | Pinelli |
| 7,546,933 | B2 | 6/2009 | Pinelli |
| D611,764 | S | 3/2010 | Wahl et al. |
| D623,473 | S | 9/2010 | Chen |
| D623,474 | S | 9/2010 | Carlson et al. |
| D623,476 | S | 9/2010 | Carlson et al. |
| D629,653 | S | 12/2010 | Gullickson et al. |
| D634,161 | S | 3/2011 | Roth et al. |
| RE42,484 | E | 6/2011 | Kitamura et al. |
| D640,094 | S | 6/2011 | Carlson et al. |
| 7,997,442 | B2 | 8/2011 | Pinelli |
| D648,985 | S | 11/2011 | Chiu et al. |
| D656,787 | S | 4/2012 | Phillips et al. |
| D658,443 | S | 5/2012 | Chiu et al. |
| D675,873 | S | 2/2013 | Miller et al. |
| D676,278 | S | 2/2013 | Wong |
| 8,464,895 | B2 | 6/2013 | Gilbert et al. |
| D686,074 | S | 7/2013 | Brinckerhoff et al. |
| 8,844,762 | B2 * | 9/2014 | Chiou ..... A47G 19/2272 215/305 |
| 8,863,979 | B2 | 10/2014 | El-Saden et al. |
| 2003/0071041 | A1 | 4/2003 | Vogel |
| 2005/0028289 | A1 | 2/2005 | Hakamiun |
| 2005/0029265 | A1 | 2/2005 | Morgan et al. |
| 2006/0043091 | A1 | 3/2006 | Pinelli et al. |
| 2006/0226160 | A1 | 10/2006 | Elsaden et al. |
| 2007/0210093 | A1 | 9/2007 | Pinelli |
| 2012/0285961 | A1 | 11/2012 | Roth et al. |
| 2013/0119060 | A1 | 5/2013 | Chiou et al. |
| 2015/0201776 | A1 * | 7/2015 | Elsaden ..... A47G 19/2272 220/715 |

* cited by examiner

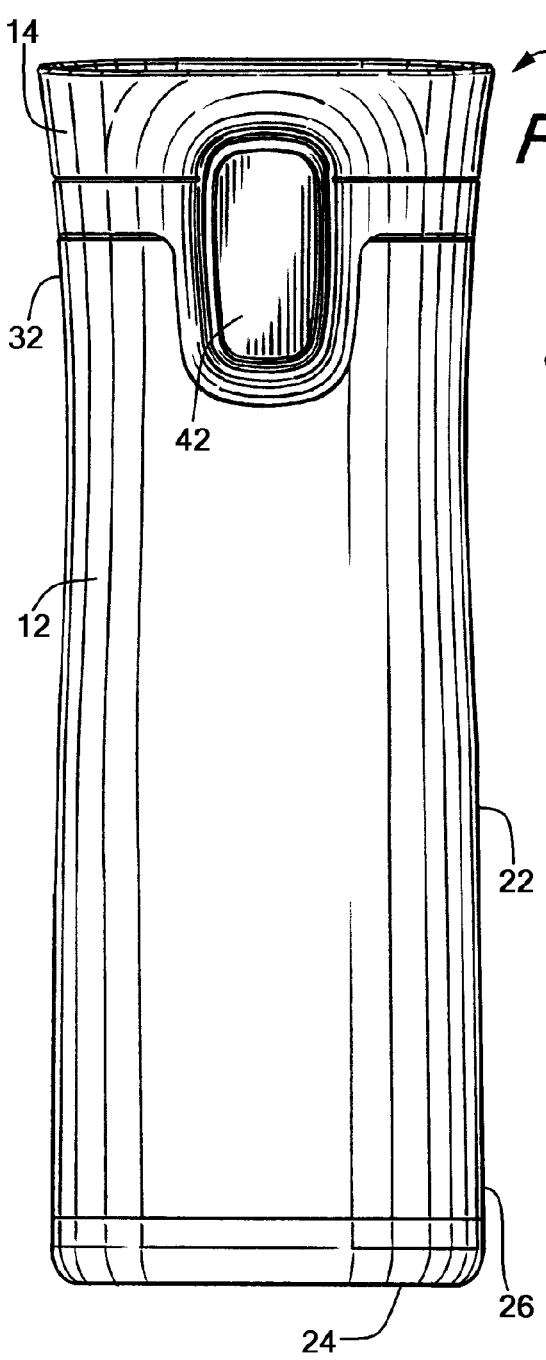
FIG. 2
FIG. 3
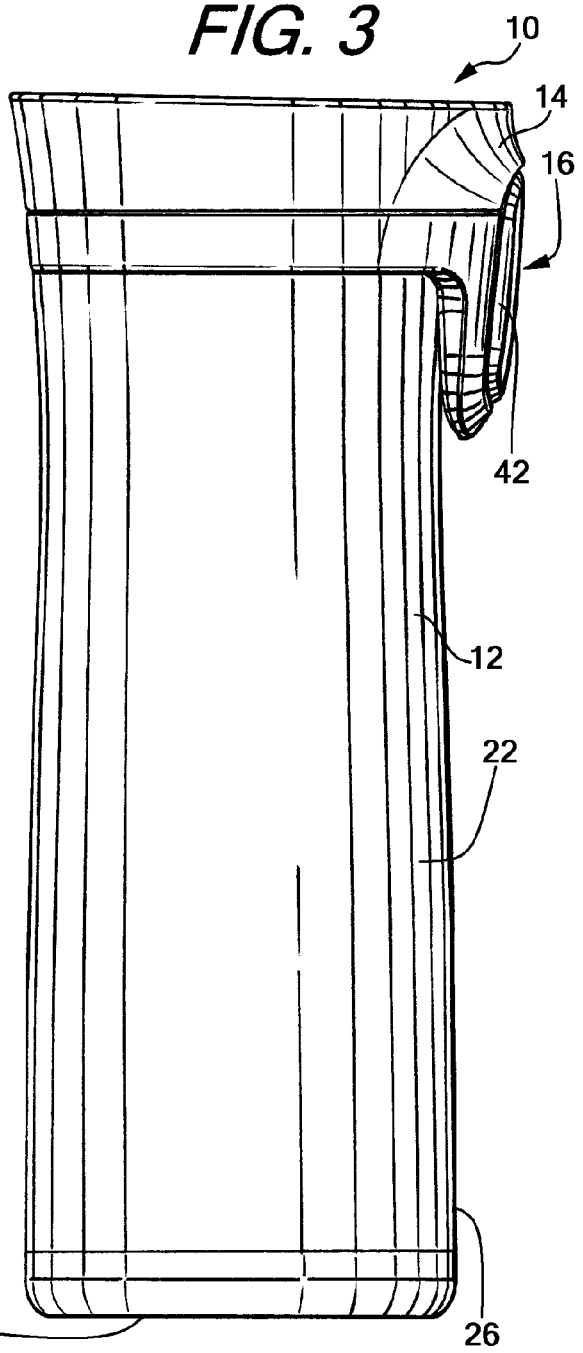

FIG. 7a
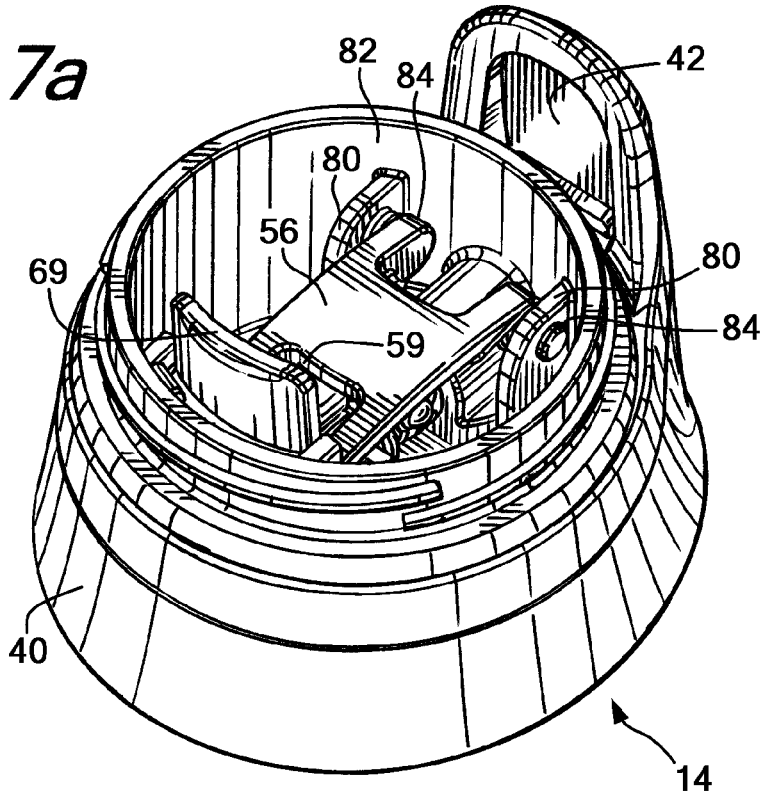
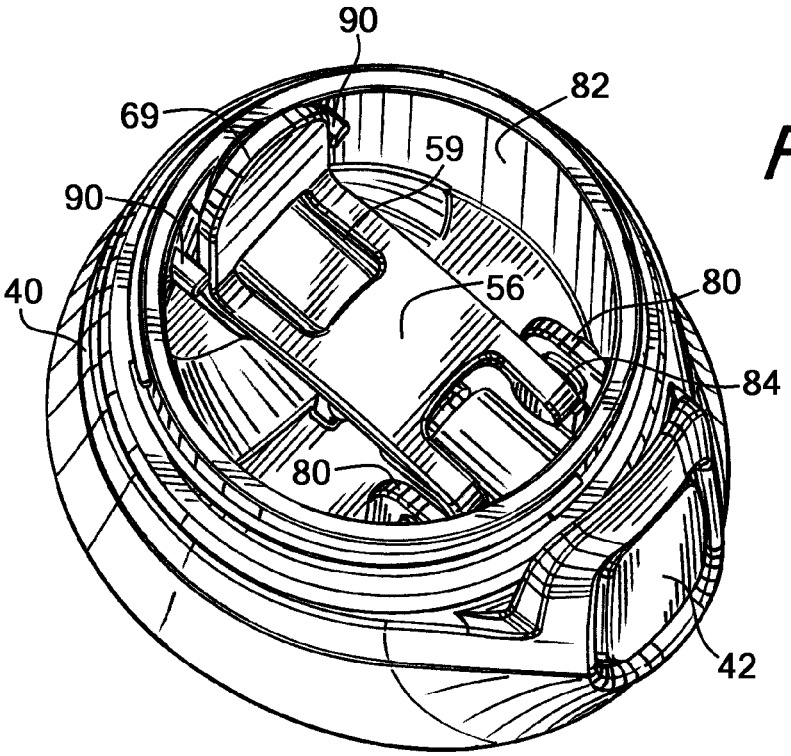
FIG. 7b

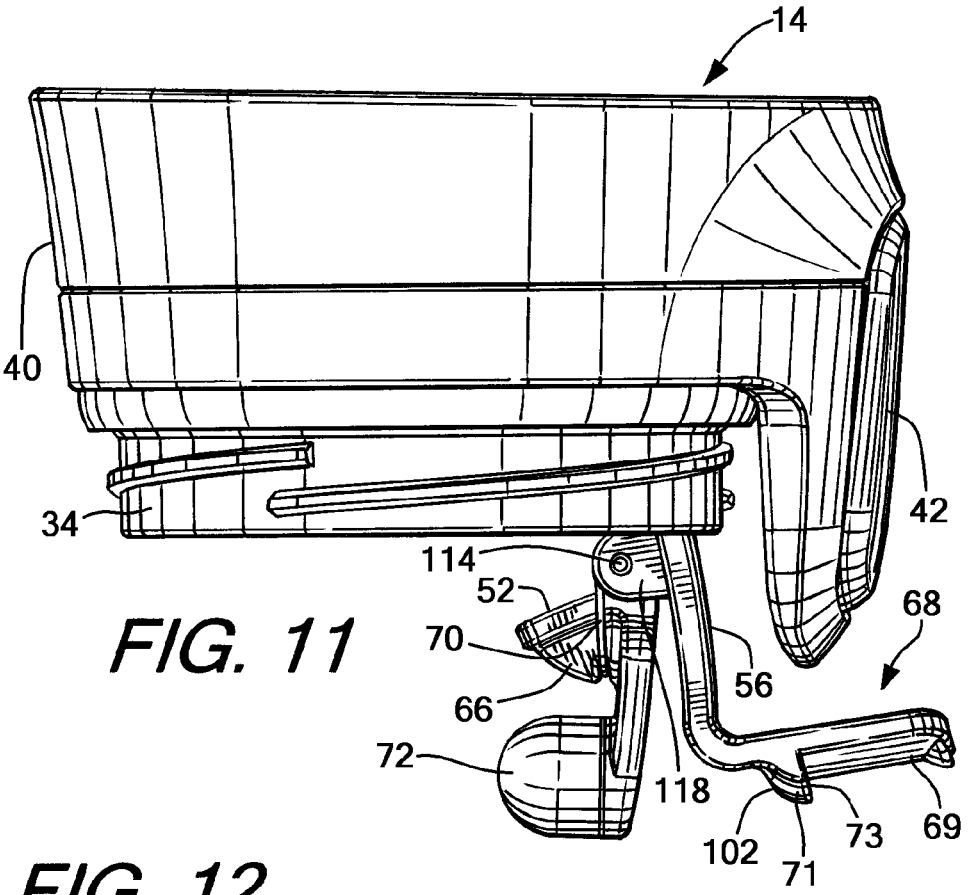
FIG. 11
FIG. 12
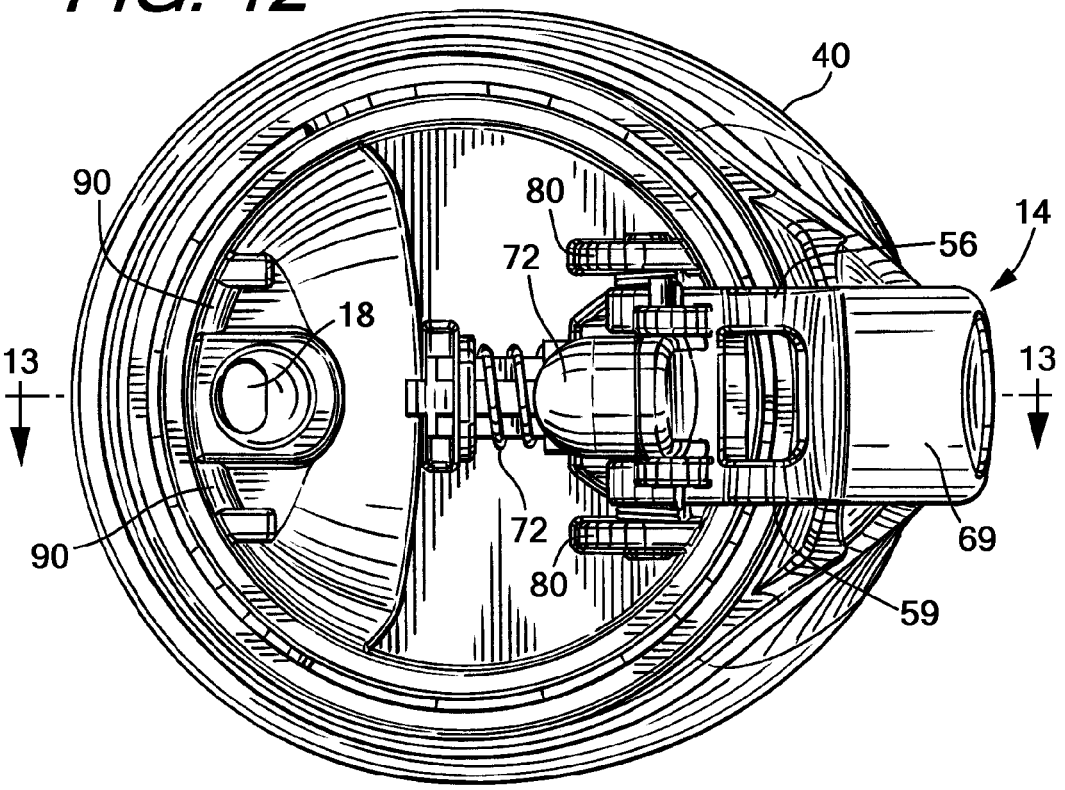

FIG. 15
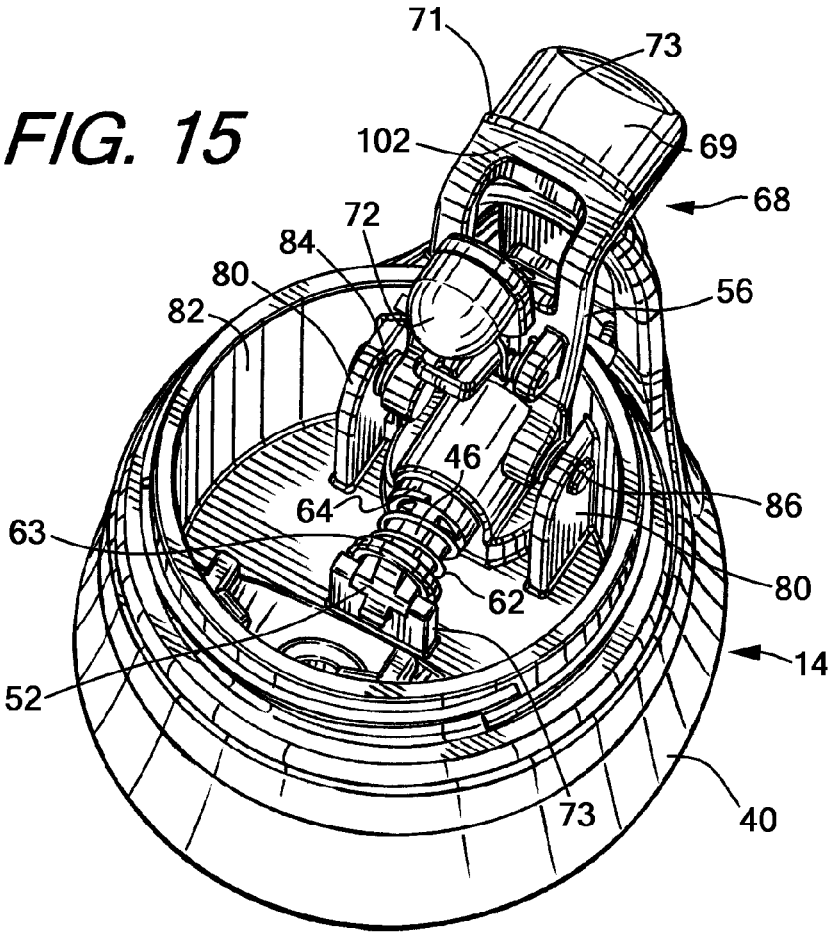
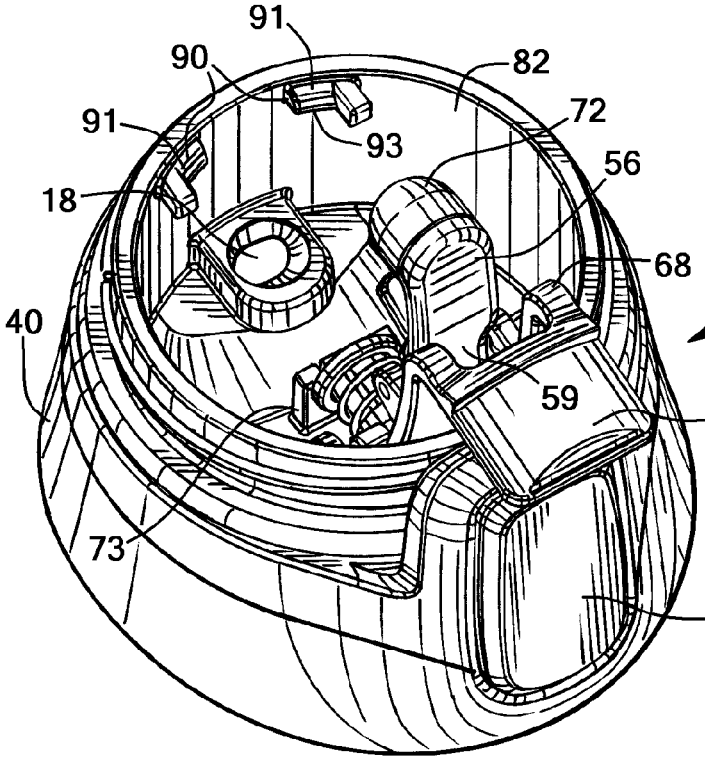
FIG. 16

TRAVEL BEVERAGE CONTAINER

CROSS-REFERENCE TO RELATED APPLICATIONS

This application claims priority to U.S. Provisional Patent Application No. 61/873,084, filed Sep. 3, 2013, which is incorporated herein by reference in its entirety and made a part hereof.

FEDERALLY SPONSORED RESEARCH OR DEVELOPMENT

Not Applicable.

TECHNICAL FIELD

The present invention relates generally to a beverage container, and more specifically to a travel beverage container with a cleanable and lockable seal assembly.

BACKGROUND OF THE INVENTION

Beverage containers and seal mechanisms for beverage containers are well known in the art. Traditionally, seal mechanisms are located in the lid of the beverage container and are secured in a fixed location in the lid adjacent the various openings in the lid housing. While such beverage containers and seal mechanisms according to the prior art provide a number of advantages, they nevertheless have certain limitations. For example, debris may be retained between certain components of the seal mechanism that are secured together. Further, the area between the seals associated with the seal mechanism and the lid, and other components of the seal mechanism and trigger mechanism are difficult to properly clean, especially in a dishwasher environment. The present apparatus seeks to overcome certain of these limitations and other drawbacks of the prior art, and to provide new features not heretofore available. A full discussion of the features and advantages of the present apparatus is deferred to the following detailed description, which proceeds with reference to the accompanying drawings.

SUMMARY

According to one embodiment, the disclosed subject technology relates to a lid for a beverage container having a drop-down seal assembly for easy cleaning of the seal assembly and the associated drink apertures, but where the seal assembly is not disassembled or removed from the lid during conversion from the use position to the cleaning position, and wherein the seal assembly is operated by a trigger assembly that is pushed radially inwardly in a direction transverse to a longitudinal axis of the beverage container.

The disclosed subject technology further relates to a lid having a lock connected to the lid housing. The lock prevents engagement of the seal assembly by the trigger assembly even when the seal assembly is in the operable position.

The disclosed subject technology further relates to a cleanable lid assembly for a beverage container having a seal assembly being connected to the lid housing while movable between a first or operable position and a second or cleaning position. The lid housing has a drink aperture. A drink stopper is adjacent the drink aperture and is adapted to open and close the drink aperture when the seal assembly is in the first position. The drink stopper is distal the drink aperture and the drink aperture is open for cleaning the lid assembly when the seal assembly is in the second position. Further, the drink stopper is not capable of closing the drink aperture in the second position.

The disclosed subject technology further relates to a seal assembly having a locking member to lock the seal assembly in the first or operable position. The locking member is moveable radially inward to disengage from the lid housing and to allow the seal assembly to be transitioned to the cleaning position.

The disclosed subject technology further relates to a trigger member that is connected to the lid housing. The trigger member is adapted to operate the drink stopper when the seal assembly is in the first position. Further, the drink stopper cannot be operated by the trigger member when the seal assembly is in the second position. In one embodiment, the trigger member is operated by pushing a portion the trigger member in a direction substantially perpendicular to a longitudinal axis of the beverage container.

The disclosed subject technology further relates to a seal assembly having a hinge member connected to the lid housing and a seal arm connected to the hinge member. In one embodiment, the drink stopper is connected to the seal arm of the seal assembly. Further, in one embodiment, the hinge member is pivotally connected to the lid housing, and the seal arm is pivotally connected to the hinge member. In such an embodiment, the seal assembly pivots away from a drink surface of the lid housing when the seal assembly transitions to the cleaning position.

The disclosed subject technology further relates to a hinge member that has a first portion that is generally perpendicular to a longitudinal axis of the container body when the seal assembly is in the first position, and a second portion that is generally parallel to the longitudinal axis of the container body when the seal assembly is in the first position. In one embodiment, the locking member extends from the second portion of the hinge member that is generally parallel to the longitudinal axis of the container body. Additionally, in one embodiment the hinge member has a joint between the first portion of the hinge member and the second portion of the hinge member. The joint allows the second portion of the hinge member to be flexed radially inward to release the locking member from the lid assembly to transition the seal assembly to the cleaning position.

The disclosed subject technology further relates to a seal assembly wherein a portion of the hinge member extends beyond a thread ring of the lid housing when the seal assembly is in the cleaning position, i.e., radially exterior of the thread ring, to assist in preventing the lid assembly from being connected to the container member when the seal assembly is in the cleaning position.

The disclosed subject technology further relates to a seal assembly having a seal assembly spring and a drink spring. The seal assembly spring biases the seal assembly toward the cleaning position when the locking member is disengaged from the lid assembly. The drink spring biases the drink stopper against the drink aperture when the seal assembly is in the first position.

The disclosed subject technology further relates to the lid assembly of having a trigger spring. In one embodiment, the trigger spring biases the trigger member away from the seal assembly.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

FIG. 2 is a front elevation view of the beverage container of FIG. 1.

FIG. 3 is a side elevation view of the beverage container of FIG. 1.

FIG. 7*a* is a bottom left perspective view of the lid of FIG. 4, with the seal assembly in the engaged position.

FIG. 7*b* is a bottom right perspective view of the lid of FIG. 4, with the seal assembly in the engaged position.

FIG. 11 is a side plan view of the lid of FIG. 4, with the seal assembly in the disengaged position.

FIG. 12 is a bottom plan view of the lid of FIG. 11, with the seal assembly in the disengaged position.

FIG. 15 is a bottom left perspective view of the lid of FIG. 4, with the seal assembly in the disengaged position.

FIG. 16 is a bottom right perspective view of the lid of FIG. 4, with the seal assembly in the disengaged position.

DETAILED DESCRIPTION

Figure 1:
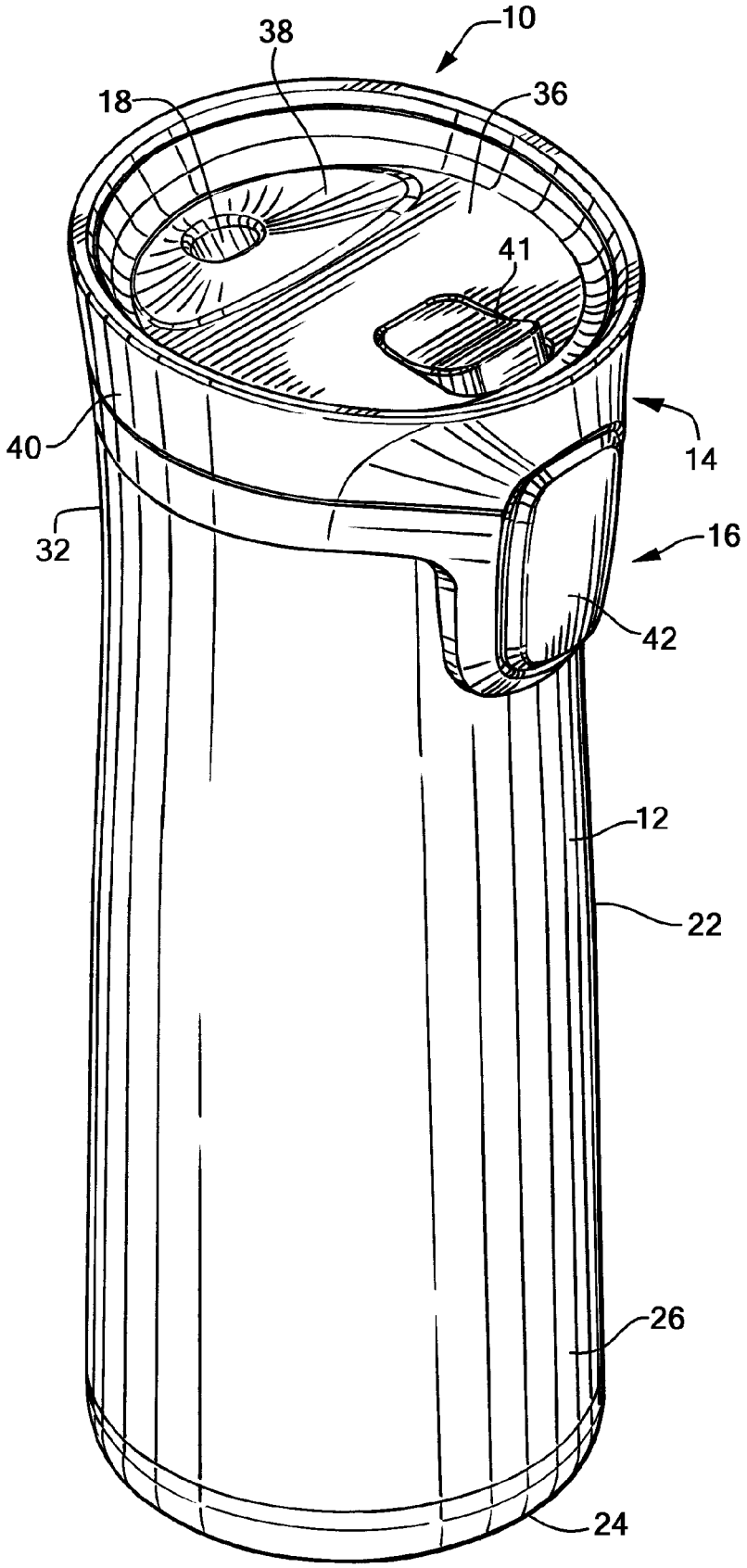
FIG. 1 is a perspective view of one example of a beverage container with a moveable and lockable seal assembly.
Figure 4:
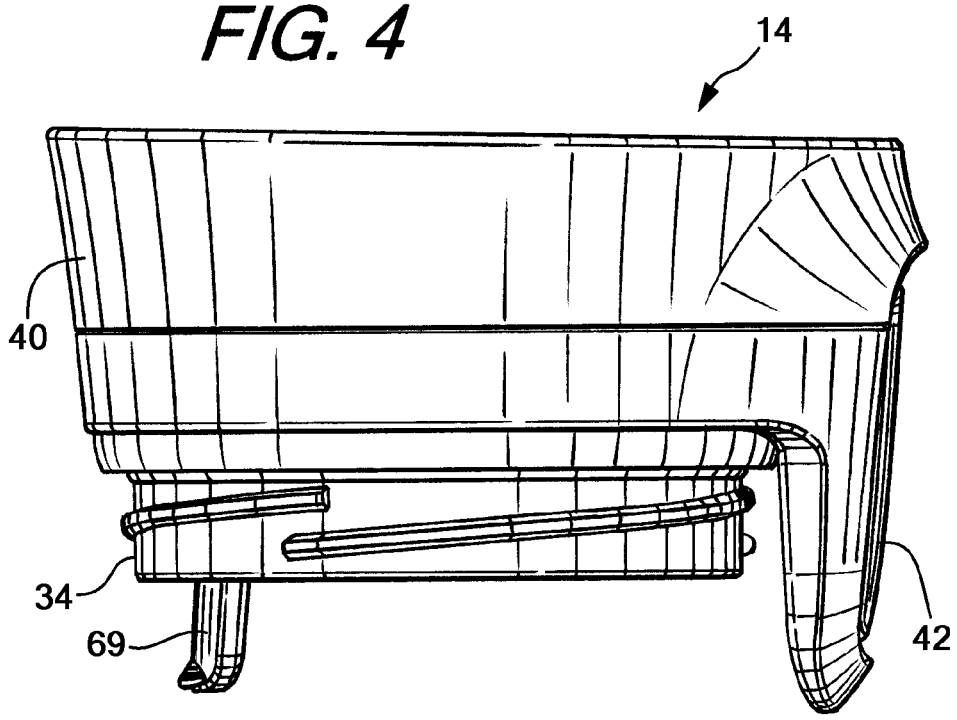
FIG. 4 is a side elevation view of one embodiment of a lid for a beverage container, including a thread ring for the lid, with the seal assembly in the engaged position.
Figure 5:
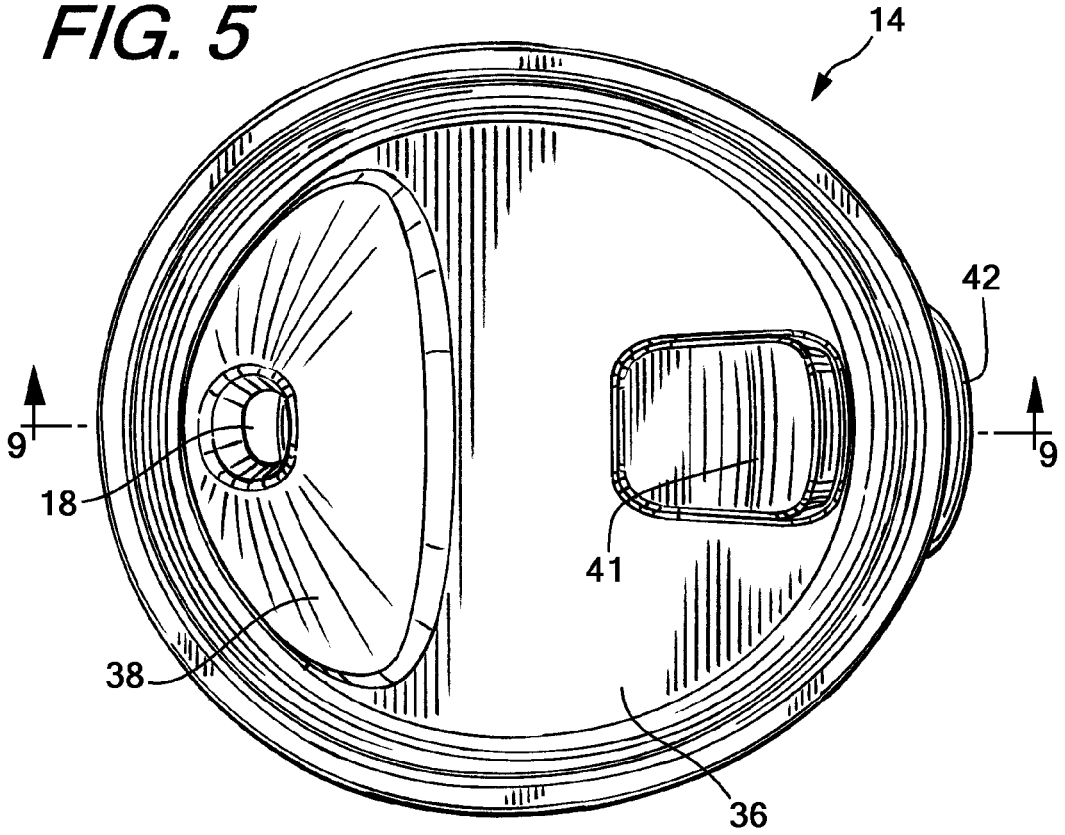
FIG. 5 is a top plan view of the lid of FIG. 4.
Figure 6:
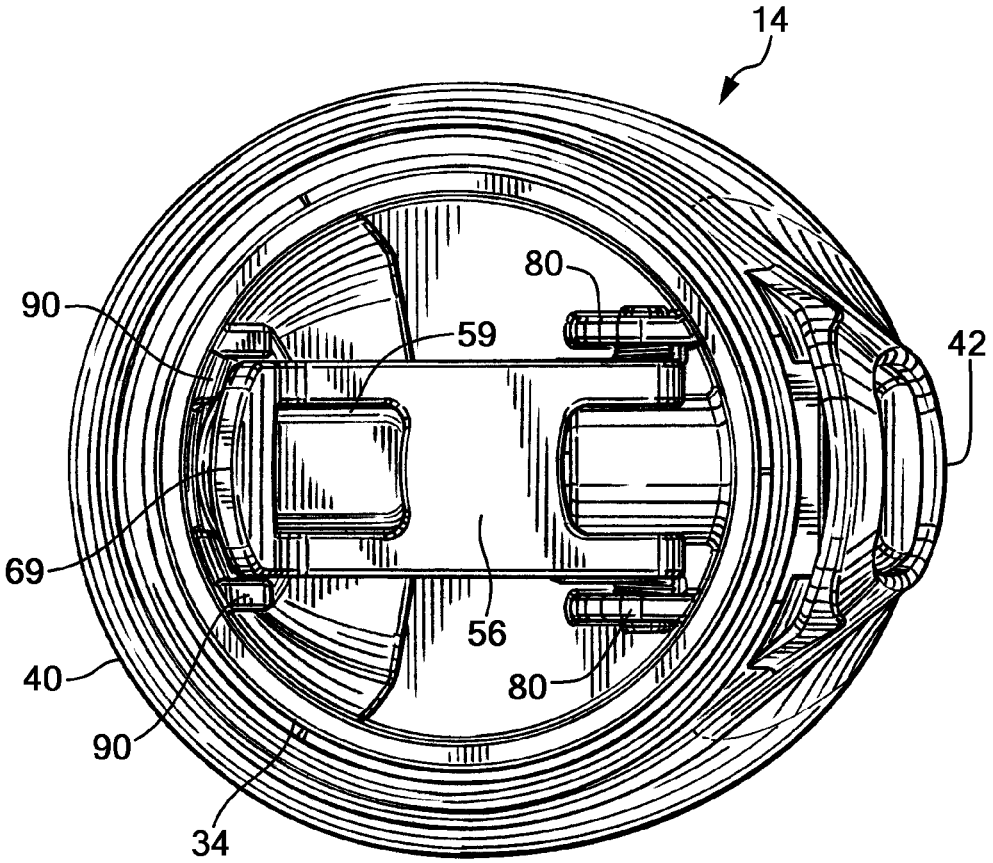
FIG. 6 is a bottom plan view of the lid of FIG. 4, with the seal assembly in the engaged position.

While the travel beverage container discussed herein is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the figures, and specifically to FIGS. 1-9, there is shown a beverage container 10 generally comprising a container body 12 and a lid assembly 14. The lid assembly 14 has a trigger mechanism 16 that operates to open and close a drinking aperture 18 in the lid assembly 14. Additionally, the trigger mechanism 16 also preferably operates to open and close a vent aperture 20 to allow pressure residing within the container body 12 to be initially released through the vent aperture 20 as opposed to the drink aperture 18. In a preferred embodiment, as shown in FIGS. 11 and 13-16, a portion of the trigger mechanism 16, referred to herein as the seal mechanism 60, can be released from a fixed or closed position to a released or open position to allow for cleaning of various components of the trigger mechanism 16 and for cleaning of areas between components of the trigger mechanism 16 and the lid assembly 14.

In one embodiment the container body 12 comprises a side wall member 22, a bottom member 24 toward a distal end 26 of the side wall member 22, and a liquid retaining cavity (not shown) therebetween. Further, in another embodiment the container body 12 preferably comprises a two-part construction of an inner member and an outer member to provide an insulating feature. The area between the inner member and the outer member may be filled with an insulating material or it may be under vacuum.

Figure 9:
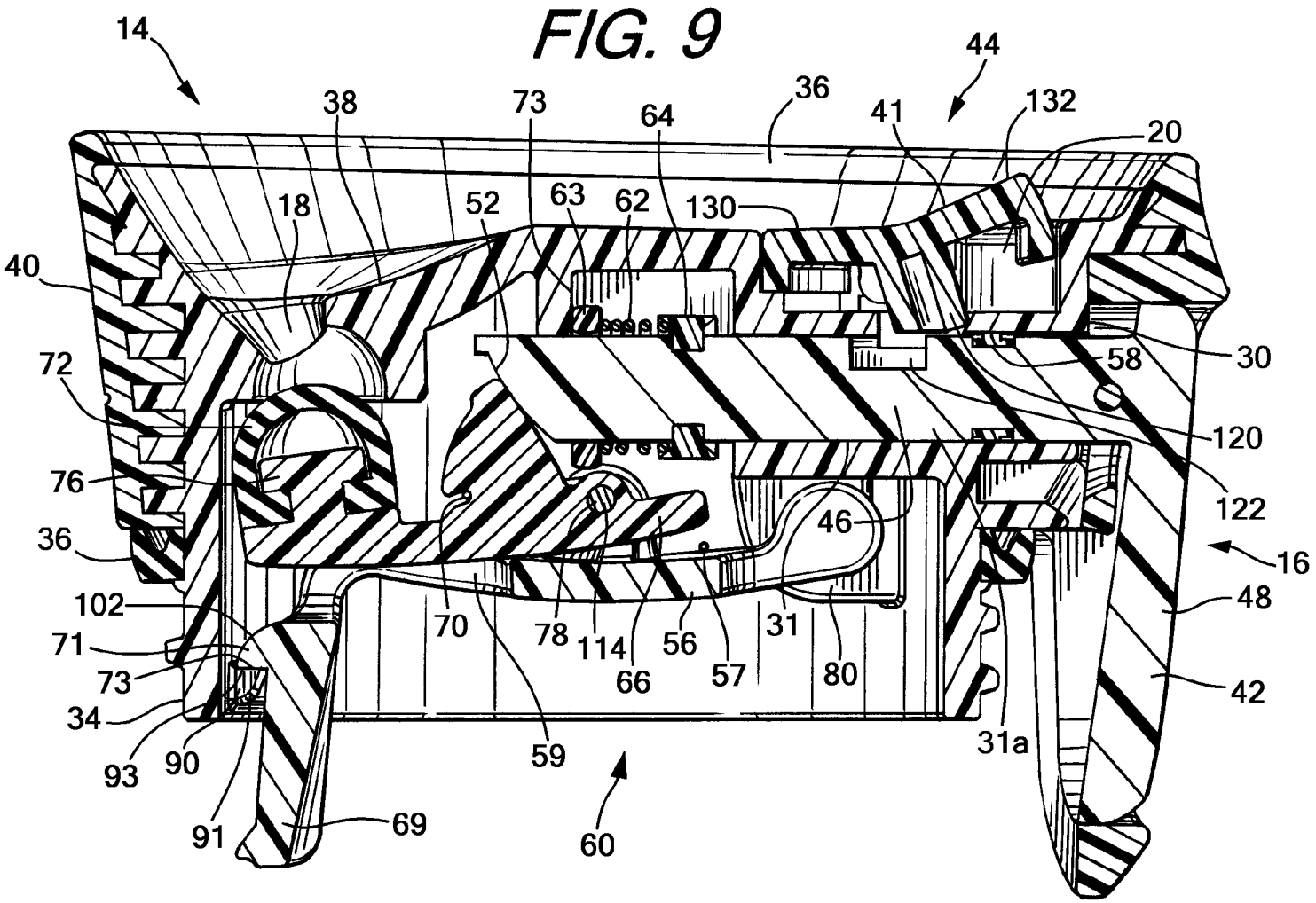
FIG. 9 is a cross-section side view of the lid for a beverage container, about line 9-9 in FIG. 5, with the trigger in the engaged position.
Figure 13:
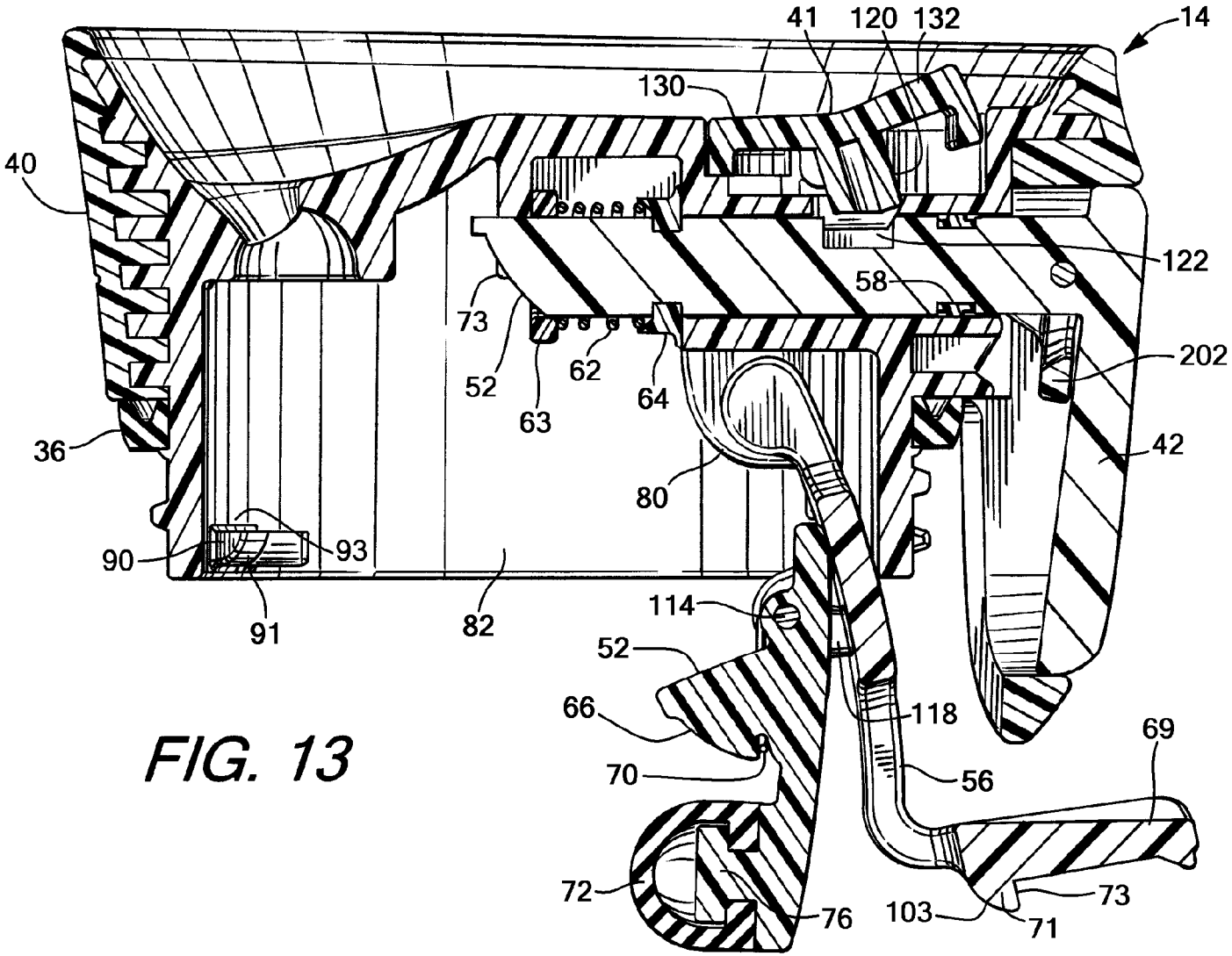
FIG. 13 is a cross-section side view of the lid for a beverage container, about line 13-13 of FIG. 12.

The lid assembly 14 provides a closure to the cavity of the container body 12. In one embodiment, the container body 12 base has a receiver (not shown) at a proximal end 32 of the container body 12 for assisting in securing the lid assembly 14 to the container body 12, and in a preferred embodiment the lid assembly 14 is secured to the container body 12 via the thread ring 34 on the lid assembly 14 and a mating receiver on the container body 12, however, alternate connection means may be utilized. In one embodiment the thread ring 34 extends from or is fixedly connected to the lid housing 40 as shown in FIGS. 9 and 13. As shown in FIGS. 9 and 13, the lid assembly 14 further includes a seal 36 that seals the connection between the container body 12 and the lid assembly 14 to assist in preventing liquid from escaping from the cavity of the container body 12 between the container body 12 and the lid assembly 14.

In one embodiment the lid assembly 14 comprises a lid housing 40 for retaining the trigger mechanism 16. Additionally, in one embodiment the top surface 36 of the lid housing 40 has a depression 38 leading to the drink aperture 18. The depression in the top surface 36 allows fluid to be dispensed from the container through the drink aperture 18, to be pooled in the depression 38, and to be subsequently slurped by the user. Any liquid that is not drunk by the user retreats back through the drink aperture 18 and into the container cavity 28 upon tilting of the drinking container 10 toward the vertical position.

The lid assembly 14 also has a trigger member or trigger button 42 that operates to actuate the trigger mechanism 16. The lid assembly 14 also has a trigger lock mechanism 44 for locking the trigger member 42 and preventing the user from actuating the trigger mechanism 16 when the trigger member 42 is locked to prevent unwanted opening of the drink aperture 18. In one embodiment the trigger member 42 is connected to the lid housing 40, and the trigger member 42 is adapted to operate the drink stopper 72 when the seal assembly 60 is in the first position. Further, the drink stopper 72 cannot be operated by the trigger member 42 when the seal assembly 60 is in the second position.

The lid housing 40 of the lid assembly 14 has a plurality of apertures therein. Preferably, the lid housing 40 contains the drink aperture 18 (see FIGS. 1, 5, 9 and 12) and the vent aperture 20 (see FIGS. 9 and 13) that provide egress for the contents in the container cavity 28 through the lid housing 40. Generally, the operation of the trigger assembly 16, and particularly the operation of the vent seal 64 of the vent aperture 20, provides to allow pressure residing within the container body 12 to preferably be initially released through the vent aperture 20 as opposed to the drink aperture 18. In one embodiment, the vent aperture 20 is provided in a position in the lid housing 40 that is underneath the vent deflector 41 that is a part of the trigger lock mechanism 44.

As best shown in FIGS. 6-11, in various embodiments the trigger assembly 16 generally comprises a trigger member 42, a hinge member 56, a drop-down spring 57, a trigger seal 58, a trigger spring 62, a washer 63, a vent seal 64, a seal arm 66, a drink spring 70 and a drink stopper 72, which in a preferred embodiment is a drink seal 72. Further, a portion of the overall trigger assembly 16 may be referred to as the seal assembly 60. In one embodiment the components of the seal assembly 60 generally comprise the hinge member 56, the drop down spring 57, the seal arm 66, the drink spring 70 and the drink stopper 72, which in a preferred embodiment is a drink seal 72. The drink stopper 72 closes the drink aperture 18 in the lid housing 40.

Referring to FIGS. 9-10 and 13-14, in one embodiment the trigger member 42 of the trigger assembly 16 is generally L-shaped, with a main body portion 46 and a transverse portion 48 extending downwardly therefrom. Moreover, in a preferred embodiment the main body portion 46 has a shaft-like shape. The main body portion 46, however, has various cutouts about an exterior of its body (see FIGS. 10 and 14) to allow gaseous fluid to pass by the exterior of the trigger member and out the vent aperture 20. The trigger member 42 has a distal end 52 that engages the seal arm 66 to rotate the seal arm 66 about its pivot point, as discussed more fully herein, thereby disengaging the drink seal 72 from the drink aperture 18 in the lid assembly 14 to operably open and close the drink aperture 18.

The main body portion 46 of the trigger 42 extends through an access aperture 30 in the lid housing 40, and into a trigger chamber 31 in the lid assembly 14. A portion of the main body portion 46 of the trigger 42 is generally housed within the trigger chamber 31, and a portion of the main body portion 46 of the trigger 42, including the distal end of the trigger 52, extends out of the trigger chamber 31, which can also be referred to as the vent chamber, and into the cavity of the lid assembly 14 to contact the seal arm 66.

Figure 10:
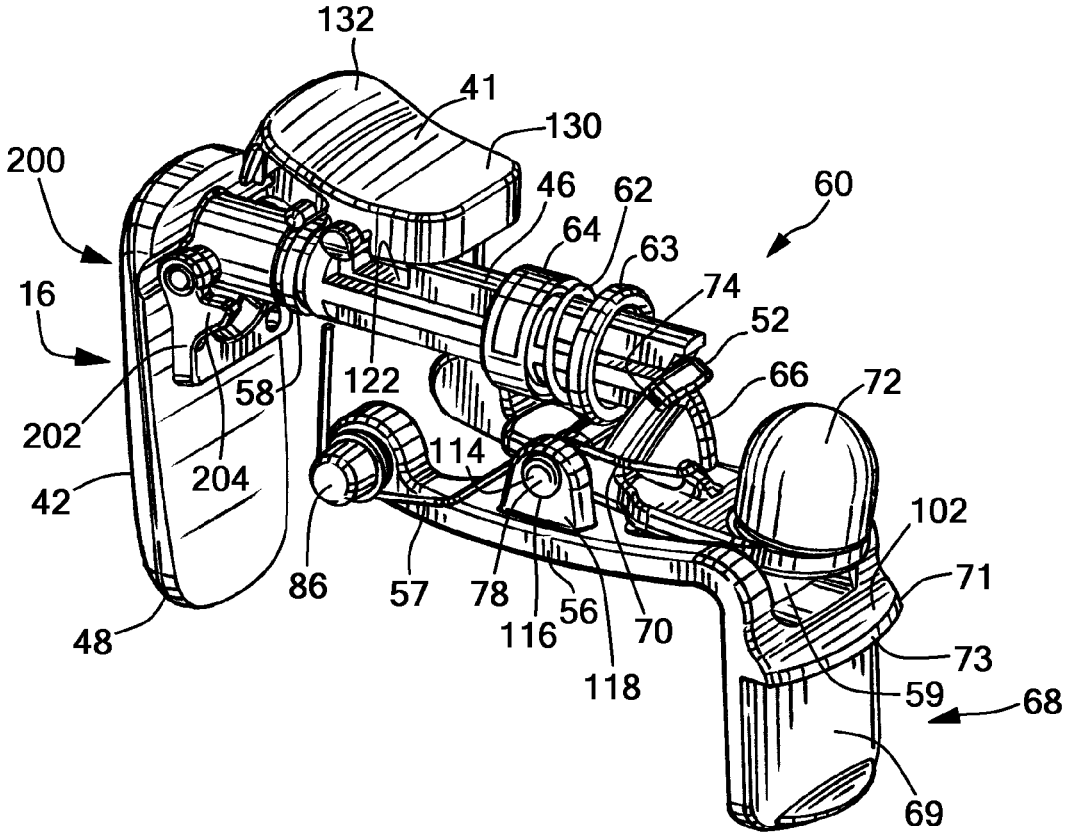
FIG. 10 is a perspective view of the trigger assembly of the lid of FIG. 4, with the lid housing removed, in the engaged position.

In a preferred embodiment the trigger 42 seats several seals, including the trigger seal 58 and the vent seal 64. As shown in FIGS. 9, 10 and 13, the trigger seal 58 and the vent seal 64 are both seated on the main body portion 46 of the trigger 42. Since the trigger 42 extends through the access aperture 30 and through the vent chamber, the trigger seal 58 is required to seal the access aperture opening 30 once the trigger 42 is inserted into the lid assembly 14. In a preferred embodiment the interior of the trigger chamber 31, a portion of which comprises the vent chamber, has a cylindrical shape and thus in this embodiment the trigger seal 58 is a wiper O-ring that is seated in an arcuate recess on the main body portion 46 of the trigger 42. The trigger seal 58 thus operates as a wiper seal contacting the interior surface of the trigger chamber 31 to seal the area between the interior surface of the trigger chamber 31 and the trigger 42 to prevent any liquid or vapor from escaping out of the trigger chamber 31 through the access aperture 30. The trigger seal 58 is positioned on the trigger 42 between the vent aperture 20 and the access aperture 30. In this manner the trigger seal 58 also operates as an end wall for the vent chamber portion 31*a* of the trigger chamber 31.

The vent seal 64 is also seated on the main body portion 46 of the trigger 42, however, the vent seal 64 is seated more toward the distal end 52 of the trigger 42 than the trigger seal 58. Like the trigger seal 58 the vent seal 64 is seated in an arcuate recess on the main body portion 46 of the trigger 42. This recess, however, is positioned outside of the trigger chamber 31 and adjacent the entrance aperture to the trigger chamber 31 and vent chamber 31*a*. Accordingly, in this manner the vent seal 64 operates to seal the entrance to the vent chamber 31*a* and trigger chamber 31 in a first normal position, as shown in FIG. 13, and to open the entrance to the vent chamber 31*a* and trigger chamber 31 immediately upon actuation of the trigger mechanism 16, including in the fully actuated position of FIG. 9.

Referring to FIGS. 9, 10 and 13, the trigger spring 62 is positioned around the main body portion 46 of the trigger 42 between the vent seal 64 and the washer 63, and adjacent the distal end 52 of the trigger member 42. In a preferred embodiment the trigger spring 62 is a compression spring. One end of the trigger spring 62 is fixed in place against the washer 63. The washer 63 is fixed axially against a wall 73 of the lid housing 40 by the spring force of the trigger spring 62. The washer 63 is not fixed to the trigger 42, or to the wall 73 of the lid housing 40, to allow the main body portion 46 of the trigger member 42 to pass freely through the washer 63 for actuation of the seal arm 66. Thus, the other end of the trigger spring 62 exerts an outwardly force on the vent seal 64 connected to the trigger 42 in an attempt to maintain the trigger 42 in the normal or unactuated position (see FIG. 13). In this position the vent seal 64 is pushed up against the outside of the trigger chamber 31 at the entrance thereto, effectively sealing the entrance to the vent chamber 31*a* and the trigger chamber 31 to preclude any liquid or vapor from being able to escape out of the container cavity 28 prior to actuation of the trigger assembly 16.

Figure 8:
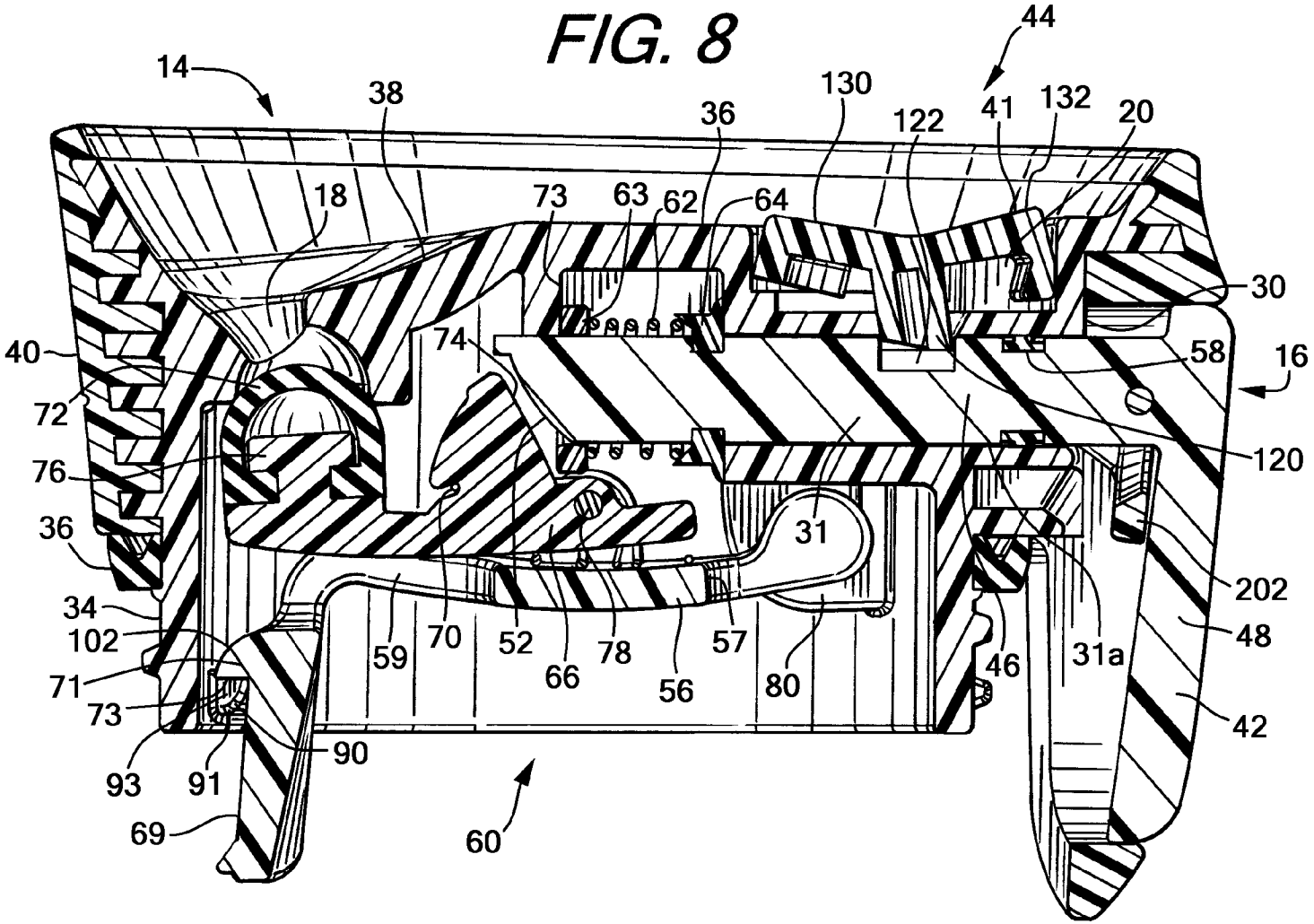
FIG. 8 is a cross-section side view of the lid for a beverage container, about line 9-9 in FIG. 5, with the trigger in the unactuated position.

The transverse portion 48 of the trigger member 42 is fixedly connected to and preferably integral with the main body portion 46 of the trigger member 42. Thus, the transverse portion 48 operates as a push-button actuator to actuate the trigger mechanism 16 and sealing assembly 60. The trigger mechanism 16 can be actuated by exerting a generally radially inward force on the trigger member 42 to overcome the opposite force of the trigger spring 62 to push the trigger member 42 radially inward in the lid assembly 14 or toward a center of the lid assembly 14, and preferably in a direction transverse to an axis extending about a length of the beverage container 10. The trigger member 42 is thus moveable from a first normal or non-actuated position shown in FIG. 8, to a partially actuated position (not shown), and ultimately to a fully actuated position shown in FIG. 9. In the partially actuated position the vent seal 64 is in the open position allowing vapor and internal pressure to be released from the container cavity 28 through the trigger chamber 31 and vent chamber and to exit out the vent orifice 20, but the drink seal 72 is closed sealing the drinking orifice 18. The gap between the distal end 52 of the trigger member 42 and the seal arm 66, shown in FIG. 8, provides a delay whereby the vent seal 64 will be moved from the opening to the trigger chamber 31 and vent chamber 31 a allowing vapor and internal pressure to be released out the vent opening 20, but the distal end 52 of the trigger member 42 will not have contacted or engaged the seal arm 66 so the drink seal 72 remains closed on the drink opening 18. Conversely, in the fully actuated position (FIG. 9) the distal end 52 of the trigger member 42 has engaged the seal arm 66, thereby rotating the seal arm 66 about its pivot point 78, such that both the vent seal 64 and drink seal 72 are in the open position allowing liquid to be expelled out the drinking orifice 18 and allowing vapor and pressure to continue to be released from the vent opening 20.

As explained above and shown in the Figures, the trigger 42 is mechanically connected to the drink seal 72 through the seal arm 66 when the trigger 42 is actuated a sufficient distance such that the distal end 52 of the trigger 42 contacts the seal arm 66.

Figure 14:
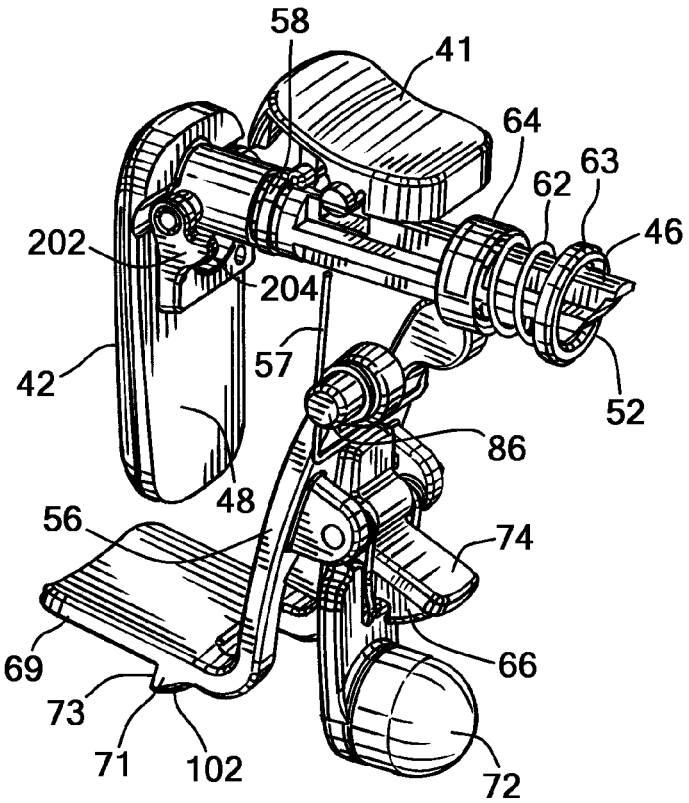
FIG. 14 is a perspective view of the trigger assembly of the lid of FIG. 4, with the lid housing removed, in the disengaged position.

Referring to FIGS. 8-16, in one embodiment a portion of the trigger assembly 16, preferably the seal assembly 60, is hingedly connected to the lower or interior portion of the lid housing 40 of the lid assembly 14. In one embodiment, a pair of arms 80 extend transversely from the interior wall 82 of the lid housing 40 (see FIGS. 7*a* and 15) to secure the seal assembly 60 to the lid housing 40. The arms 80 have a receiver 84 for pivotally securing the hinge member 56 to the lid housing 40. In one embodiment, the receiver 84 in the arms 80 is a bore 84 that is sized to allow extensions 86 of the hinge member 56 to extend and rotate therewithin. Referring to FIGS. 10 and 14, in one embodiment the extensions 86 comprise shaft-like members that extend from the body of the hinge member 56 and into the receivers 84 in the arms 80 of the lid housing 40. As such, the hinge member 56, and the seal assembly 60 therewith, when unlocked, can pivot down from its engaged position about the extensions 86 that rotate within the receivers 84 to allow access to various components of the seal assembly 60, trigger assembly 16 and lid assembly 14 for cleaning purposes. Thus, the hinge member 56 is pivotally connected to the lid housing 14 in a preferred embodiment.

The seal assembly 60, however, can be locked and unlocked to the lid housing 40 to either maintain the seal assembly 60 in the operable position (as shown in FIGS. 6-9), or to allow the seal assembly 60 to be pivoted downward (as shown in FIGS. 11-16). Referring to FIGS. 10-16, the pivotable portion of the seal assembly 60 comprises the hinge member 56, the drop down spring 57 (also referred to as the seal assembly spring 57), the seal arm 66, the drink spring 70 and the drink seal 72. In one embodiment, the hinge member 56 has a seal arm locking member 68. In a preferred embodiment the seal arm locking member 68 comprises a locking extension 69 of or from the hinge member 56 that can be grasped by the user to unlock the hinge member 56 from the lid housing 40 so that the seal assembly 60 can be rotated outwardly to the open position for cleaning. In a further preferred embodiment the locking extension 69 of the seal arm locking member 68 has a locking flange 71 to lock the seal arm locking member 68 to the lid housing 40. In a preferred embodiment, the locking flange 71 and the locking extension 69 are a unitary component with the hinge member 56.

Referring to the FIG. 8, in one embodiment the hinge member 56 has a first portion 56 that is generally perpendicular to a longitudinal axis of the container body 12 when the seal assembly 60 is in the first position, and a second portion 69, also referred to as the locking extension 69, that is generally parallel to the longitudinal axis of the container body 12 when the seal assembly 60 is in the first position. The locking member 90 extends from the second portion 69 that is generally parallel to the longitudinal axis of the container body 12. The hinge member 56 has a joint between the first portion of the hinge member 56 and the second portion 69 of the hinge member. In one embodiment the joint assists in having the second portion 69 of the hinge member able to be flexed radially inward to release the locking member 90 from the lid assembly to transition the seal assembly 60 to the cleaning position. In a preferred embodiment the hinge member 56, including both the first portion and the second portion thereof as well as the locking member, is a single unitary component that is pivotally connected to the lid housing 40 at one end and is able to the connected to the opposing side of the lid housing 40 via the locking member 90 thereof. Having a single component as a hinge member provides multiple benefits, including reducing components for manufacturing and assembly purposes, reducing complexity of use during transition to the cleaning position, and reducing areas where dirt and bacteria can reside.

As shown in FIGS. 10-16, in one embodiment, the seal assembly 60 is connected to the lid housing while movable between the first or operable position and the second or cleaning position. In this embodiment, the drink stopper 72, which in a preferred embodiment is a drink seal 72, however the drink seal may alternately be on the drink aperture 18 and the drink stopper 72 may engage the drink seal on the drink aperture 18 to sealingly close the drink aperture 18, is adjacent the drink aperture 18 and is adapted to open and close the drink aperture 18 in the first position. Additionally, in the second position the drink stopper 72 is distal the drink aperture 18 and the drink aperture 18 is open for cleaning the lid assembly when the seal assembly 60 is in the second position. Further, the drink stopper 72 is not capable of closing the drink aperture 18 in the second position.

In a preferred embodiment, the seal arm locking member 68 is a component of the seal assembly 60 and the trigger assembly 16. The seal arm locking member 68 is used to lock the seal assembly 60 and trigger assembly 16 in the operable position, and further unlock the seal assembly 60 and trigger assembly 16 for transitioning to the unlocked or cleaning position. In one embodiment, locking extension 69 of the seal arm locking member 68 is resilient and able to be flexed at the joint where it connects to the hinge member 56 when pressure is applied by the user as explained herein to assist in the unlocking process. Further, in a preferred embodiment the locking member 68 engages the lid housing in the first position, and the locking member 68 is moveable radially inward to disengage the seal assembly 60 from the first position and to allow the seal assembly 60 to be transitioned to the cleaning position.

As best shown in FIGS. 8-11 and 13, the locking flange 71 of the seal arm locking member 68 extends transversely from the locking extension 69. In one embodiment the seal arm locking member 68 has one locking flange 71 extending in away from the locking extension 69, however additional locking flanges 71 may be included. In a preferred embodiment, each of the locking flanges 71 have a top surface 102 that operates as a cam follower 102 to engage a cam surface 91 of respective retaining members 90 on the inner wall 82 of the thread ring 34 of the lid housing 40 (See FIGS. 8-9 and 16). In a preferred embodiment, the cam surface 102 of the locking flange 71 has an arcuate geometry. The locking flange 71 also has a flat 73. In one embodiment the flat 73 operates as a stop and is opposite the cam follower surface 102. The flat 73 does not have to have a flat geometry.

In one embodiment the lid housing 40 has a receiving member 90, see FIG. 16, that provides a cam receiving surface 91 and a stop surface 93 for receiving the locking flange 71, and thus for retaining the seal assembly 60 in the locked position. Referring to FIGS. 8, 9, 13 and 16, in a preferred embodiment, two receiving members 90 are provided and they extend transversely from the interior wall 82 of the lid housing 40. In one embodiment, the cam receiving surface 91 is arcuate in shape.

As shown in FIGS. 8, 9 and 13, the cam follower surface 102 of the locking flange 71 engages the cam receiving surface 91 of the receiving members 90 when the seal arm locking member 68 is pushed inwardly or upwardly toward a top of the lid housing 40. The locking extension 69 can flex radially inwardly as the cam follower surface 102 traverses on the cam receiving surface 91. When the seal arm locking member 68 is pushed a certain distance, the flat 73 of the locking flange 71 moves beyond the cam receiving surface 91 of the receiving member 90 and the locking extension 69 will flex or snap outwardly so that the flat 73 on the seal arm locking member 68 rests on the step 93 of the receiving member 90 to lock the seal assembly 60 to the lid assembly 14 in the closed or locked position in the lid assembly 14 (see FIGS. 8 and 9). Accordingly, the cam receiving surfaces 91 of the receiving members 90 operate as cam surfaces for the cam follower surface 102 of the locking flange 71. When the seal arm locking member 68 has been pushed far enough and the seal arm locking member 68 having the locking flange 71 springs outwardly so that the flat 73 of the locking flange 71 engages the stops 93 of the receiving members 90 in a snap-fit manner, the user is provided with a tactile sensation indicating that the proper insertion of the seal arm locking member 68 has been achieved and the seal arm locking member 68 and hinge member 56 have been properly locked in the use position. The engagement of the locking flange 71 with the receiving member 90 also operates to fix the seal assembly 60 in the locked position until unlocked by the user for cleaning. In this manner the seal assembly 60 will not become unintentionally unlocked.

To unlock the seal arm locking member 68, and thus the seal assembly 60, the user pushes the locking extension 69 of the seal arm locking member 68 generally radially inwardly toward the center of the lid housing 40. The seal arm locking member 68 may flex at the joint with the hinge member 56 allowing the seal arm locking member 68 to flex generally radially inwardly. Accordingly, upon receipt of a force applied by a user to the locking extension 69, i.e., the second portion of the hinge member 56, the locking member 68 will flex radially inward. When the flat 73 of the locking flange 71 clears the stop 93 of the receiving member 90 the user can also pull the seal arm locking member 68 outwardly from the lid housing 40. Additionally, the drop down spring 57, which in one embodiment is preferably a torsion spring, exerts a force on the seal assembly 60 to rotate or bias the seal assembly 60 into the cleaning position as shown in FIGS. 11-16. The drop down spring 57 also operates to maintain the seal assembly 60 in the open or cleaning position until a user exerts a force to sufficient to overcome the spring force of the drop down spring 57 and to place the seal assembly 60 in the use position. Thus, during cleaning, for example in a dishwasher, the seal assembly 60 will be maintained open by the drop down spring 57. In the cleaning position a portion of the seal assembly 60 is preferably positioned radially exterior of the thread ring 34. In that location lid assembly 14 cannot be connected to the container body 12 until the seal arm assembly 60 has been locked in the closed or use position because in the cleaning position a portion of the hinge member 56. In a preferred embodiment the locking extension 69 of the seal arm locking member 68, will obstruct the thread ring 34 on the lid assembly 14 from being able to engage the mating receiver on the container body 12.

Referring now to FIGS. 8-10, in one embodiment the seal arm 66 of the seal assembly 60 is pivotally attached to the hinge member 56. The seal arm 66 has an engaging surface 74 that is engaged by the distal end 52 of the trigger 42 during actuation of the trigger mechanism 16. As shown in FIG. 8, the engaging surface 74 of the seal arm 66 is positioned a gap distance from the distal end 52 of the trigger member 42 in the unactuated position. The seal arm 66 also has an extension 76 to retain the drink seal 72. The extension 76 of the seal arm 66 is positioned opposite the engaging surface 74.

As shown in FIGS. 8-11, a pin or shaft 114 secures the seal arm 66 to the hinge member 56 is a pivoting manner. The seal arm 66 has a bore 116 through which the shaft 114 extends, and the hinge member 56 has a pair of receivers 118 that receive and secure the shaft 114 in place. Accordingly, the seal arm 66 is pivotally attached to the hinge member 56.

The drink spring 70 is also provided as part of the seal assembly 60 to exert a force on the seal arm 66 to bias or maintain the drink seal 72 in the closed position until a sufficient force is provided against the seal arm 66 through the trigger mechanism 16 to overcome the force of the drink spring 70 and thus pivot the seal arm 66 and drink seal 72 about the shaft 114 away from the drink aperture 18. During rotation of the seal arm 66 the hinge member 56 remains fixed in place and does not move (see FIGS. 8 and 9). In one embodiment, the drink spring 70 is a torsion spring that is exerts a pressure on the seal arm 66 such that the seal arm 66 is forced away from the hinge member 56 and toward the trigger 42. Thus, when the seal assembly 60 is positioned in the locked or operational position (see FIGS. 8 and 9) the locking flange 71 of the seal arm locking member 68 is secured to the lid housing 40 through the receiving members 90. In this position, the drink seal 72 of the seal assembly 60 is forced against the drink opening 18 via the drink spring 70 to close the drink opening 18 (see FIG. 8).

When the user desires to drink from the container 10, the user depresses the trigger member 42 by pushing the trigger member 42 inward toward the container body 12 with sufficient force to overcome the resistance force of the trigger spring 62. The trigger member 42 moves inwardly and the vent seal 64 is moved from the entrance to the trigger chamber 31 and vent chamber 31*a*. During the beginning portion of the stroke of the trigger member 42 the distal end 52 of the trigger member 42 remains out of contact of the seal arm 66 because of the gap between the seal arm 66 and the trigger member 42 (see FIG. 8). When sufficient stroke of the trigger member 42 has occurred, the distal end 52 of the trigger member 42 will contact the seal arm 66. Further stroke movement of the trigger member 42 will operate to push against the seal arm 66, thereby causing the seal arm 66 to rotate about the shaft 114 at its pivot point 78 within the receivers 118 of the hinge member 56 because the hinge member 56 is fixed in the locked position. To rotate the seal arm 66 the force exerted on the trigger member 42 must not only be sufficient to overcome the continuing force of the trigger spring 62, but also be sufficient to overcome the force of the drink spring 70, thus allowing the seal arm 66 to compress the drink spring 70 and have the drink seal 72 be moved away from the drink apertures 18 to allow liquid to escape out of the drink aperture 18 for drinking (see FIG. 9).

As shown in FIGS. 9-10 and 14-16, the hinge member 56 has an aperture 59 to allow the seal arm 66 to fully rotate for opening the drink aperture 18 when forced by the trigger member 42 without hitting the hinge member 56. In this manner sufficient flow area will be provided between the drink seal 72 and the drink aperture 18. The hinge member 56 also operates as a guard, such as an ice guard, to prevent ice or other items within the beverage container 10 from disrupting operation on the trigger assembly 16.

When the user removes force from the drink trigger 42 (i.e., generally by removing their finger or thumb from the trigger 42), the force of the drink spring 70 will force the seal arm 66 to rotate toward the lid housing 40 and thereby have the drink seal 72 forced against the drink opening 18 to close the drink opening 18. Further, the trigger spring 62 will continue to force the trigger 42 outwardly to seal the vent seal 64 against the outside of the seal chamber 31*a* and trigger chamber 31, thereby closing the vent opening 20.

If the user desires to clean the lid assembly 14, the user can pivot or rotate the seal assembly 60 away from the lid housing 40 to provide access to the area between the drink opening 18 and the drink seal 72 (see FIGS. 11-16). To do such, in one embodiment the user pushes the locking extension 69 of the seal arm locking member 68 radially inwardly toward the center of the lid housing 40. The seal arm locking member 68 will flex at the joint with the hinge member 56 allowing the seal arm locking member 68 to flex inwardly. When the flat 73 of the locking flange 71 clears the stop 93 of the receiving member 90 the user can also pull the seal arm locking member 68 outwardly from the lid housing 40. Additionally, the drop down spring 57 exerts a force on the seal assembly 60 to rotate the seal assembly into the cleaning position as shown in FIGS. 11-16.

The lid assembly 14 also has a trigger locking mechanism 44 to prevent the trigger 42 from being actuated when the trigger lock mechanism 44 is in the locked position. In one embodiment the trigger lock mechanism 44 comprises a moveable vent deflector 41 with a shoulder 120 that is adapted to engage a cutout 122 in the trigger member 42 and prevent inward movement (i.e., actuation) of the trigger member 42. The vent deflector 41 can be transitioned from the locked position (see FIG. 8), where the shoulder 120 of the vent deflector 41 is positioned within the trigger chamber 31, and more specifically within the cutout 122 in the trigger member 42, thereby contacting the trigger member 42 such that the trigger member 42 cannot be moved inwardly thereby preventing the trigger mechanism 16 from being actuated, to the unlocked position (see FIG. 9), where the shoulder 120 of the vent deflector 41 is positioned outside of the trigger chamber 31 and thus not in contact with the trigger member 42 such that the trigger member 42 can be moved inwardly to actuate the trigger mechanism 16.

Referring to FIG. 8, when the front end 130 of the vent deflector 41 toward the drink aperture 18 is in the up position the rear end 132 of the vent deflector 41 is in the down position and the shoulder 120 engages the cutout 122 in the trigger member 42 to prevent inward movement (i.e., actuation) of the trigger member 42. The front end 130 of the vent deflector 41 may have a visual indicator, such as a red color or words, such as "LOCKED", that appears when the trigger lock mechanism 44 is in the locked position to indicate to the user that the trigger mechanism 16 is locked and cannot be actuated. To allow for actuation, the user presses down on the front end 130 of the vent deflector 41, thereby pivoting the front end 130 downward and the rear end 132 of the vent deflector 41 upward as shown in FIG. 9. In this position, the shoulder 120 disengages from the cutout 122 in the trigger member 42 and allows the trigger member 42 to move inwardly when a force is applied by the user to the trigger member 42.

In various embodiments of the drinking container 10, the trigger mechanism 16 of the drinking container 10 may also have a tilt-lock mechanism 200. The tilt-lock mechanism 200 prevents the trigger 42 from being actuated when the beverage container 10 is tilted, prior to the trigger 42 being actuated, beyond a certain angle, such as, for example, 15°. The tilt-lock mechanism 200 includes a tilt-pendulum 202 (see FIGS. 8-10 and 14). The tilt-pendulum 202 is rotatedly connected to the trigger 42. The tilt-pendulum 202 has a pair of ears 204 extending therefrom which operate to assist in locking the trigger mechanism 16 when the drinking container 10 is rotated beyond a certain angle, but only if the drinking container 16 is rotated before the trigger 42 is depressed. Accordingly, when the drinking container 10 is in the upright position, the tilt pendulum 202 is free to fall straight down due to the effect of gravity. In this position the trigger 42 can be pressed and the tilt pendulum 202 does not make any contact with the lid housing 40. When the drinking container 20 is tilted forward prior to the trigger 42 being depressed, the tilt pendulum 202 rotates forward as well, moving into a position that will cause a 'lock' between the lid housing 40 and the trigger 42, thereby preventing the trigger 42 from being depressed.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A cleanable lid assembly for a beverage container, comprising:

a lid housing having a drink aperture;

a seal assembly having a drink stopper that closes the drink aperture, the seal assembly being connected to the lid housing while movable between a first or operable position and a second or cleaning position, wherein the drink stopper is adjacent the drink aperture and is adapted to open and close the drink aperture in the first position, wherein the drink stopper is distal the drink aperture and the drink aperture is open for cleaning the lid assembly when the seal assembly is in the second position, and wherein the drink stopper is not capable of closing the drink aperture in the second position;

the seal assembly having a locking member that engages the lid housing when the seal assembly is in the first position, the locking member being moveable radially inward to disengage the seal assembly from the first position and to allow the seal assembly to be transitioned to the cleaning position; and, a trigger member connected to the lid housing, wherein the trigger member is adapted to operate the drink stopper when the seal assembly is in the first position, and wherein the drink stopper cannot be operated by the trigger member when the seal assembly is in the second position.

2. The lid assembly of claim 1, wherein the seal assembly further comprises a hinge member connected to the lid housing and a seal arm connected to the hinge member, the drink stopper being connected to the seal arm.

3. The lid assembly of claim 2, wherein the hinge member has a first portion that is generally perpendicular to a longitudinal axis of the container body when the seal assembly is in the first position, and a second portion that is generally parallel to the longitudinal axis of the container body when the seal assembly is in the first position, the locking member extending from the second portion that is generally parallel to the longitudinal axis of the container body, and a joint between the first portion of the hinge member and the second portion of the hinge member, the second portion of the hinge member adapted to be flexed radially inward to release the locking member from the lid assembly to transition the seal assembly to the cleaning position.

4. The lid assembly of claim 2, wherein the hinge member, including the first portion, the second portion and the locking member, is a single unitary component.

5. The lid assembly of claim 2, wherein the hinge member is pivotally connected to the lid housing, and wherein the locking member extends transversely from the hinge member.

6. The lid assembly of claim 2, wherein the hinge member is pivotally connected to the lid housing, and wherein the seal arm is pivotally connected to the hinge member.

7. The lid assembly of claim 1, wherein the seal assembly pivots away from a drink surface of the lid housing when the seal assembly transitions to the cleaning position.

8. The lid assembly of claim 1, further comprising a seal assembly spring to bias the seal assembly toward the cleaning position when the locking member is disengaged from the lid assembly, and a drink spring to bias the drink stopper against the drink aperture when the seal assembly is in the first position.

9. The lid assembly of claim 8, wherein a portion of the hinge member extends radially exterior of a thread ring of the lid housing when the seal assembly is in the cleaning position to assist in preventing the lid assembly from being connected to the container member when the seal assembly is in the cleaning position.

10. The lid assembly of claim 1, wherein the drink stopper is a drink seal.

11. The lid assembly of claim 2, further comprising a seal assembly spring to bias the hinge member toward the cleaning position when the locking member of the seal assembly is disengaged from the lid assembly, and a drink spring to bias the drink stopper against the drink aperture when the locking member is engaged with the lid assembly.

12. The lid assembly of claim 1, wherein the trigger member is operated by pushing the trigger member in a direction substantially perpendicular to a longitudinal axis of the beverage container.

13. A cleanable lid assembly for a beverage container, comprising:

a lid housing having a drink aperture;

a seal assembly being connected to the lid housing while movable between a first or operable position and a second or cleaning position, the seal assembly having a drink stopper that closes the drink aperture and a locking member that engages the lid housing in the first position to retain the seal assembly in the first position, the locking member being moveable radially inward to disengage the seal assembly from the first position and to allow the seal assembly to be transitioned to the cleaning position, wherein the drink stopper is adjacent the drink aperture and is adapted to open and close the drink aperture in the first position, wherein the drink stopper is distal the drink aperture and the drink aperture is open for cleaning the lid assembly when the seal assembly is in the second position, and wherein the drink stopper is not capable of closing the drink aperture in the second position;

a seal assembly spring to bias the seal assembly toward the cleaning position when the locking member of the seal assembly is disengaged from the lid assembly; and, a drink spring to bias the drink stopper against the drink aperture when the seal assembly is in the first position.

14. The lid assembly of claim 13, further comprising a trigger member connected to the lid housing, wherein the trigger member is adapted to operate the drink stopper when the seal assembly is in the first position, and wherein the drink stopper cannot be operated by the trigger member when the seal assembly is in the second position.

15. The lid assembly of claim 14, further comprising a trigger spring to bias the trigger member away from the seal assembly.

16. The lid assembly of claim 13, wherein the seal assembly further comprises a hinge member pivotally connected to the lid housing and a seal arm pivotally connected to the hinge member, the drink stopper being connected to the seal arm, and wherein the locking member extends transversely from the hinge member.

17. The lid assembly of claim 16, wherein the hinge member has a first portion that is generally perpendicular to a longitudinal axis of the container body when the seal assembly is in the first position, and a second portion that is generally parallel to the longitudinal axis of the container body when the seal assembly is in the first position, the locking member extending from the second portion that is generally parallel to the longitudinal axis of the container body, and a joint between the first portion of the hinge member and the second portion of the hinge member, the joint allowing the second portion of the hinge member to be flexed radially inward to release the locking member from the lid assembly to transition the seal assembly to the cleaning position.

18. A cleanable lid assembly for a beverage container, comprising:

a lid housing having a drink aperture; and, a seal assembly being connected to the lid housing while movable between a first or operable position and a second or cleaning position, the seal assembly having a hinge member pivotally connected to the lid housing and a seal arm pivotally connected to the hinge member, a drink stopper connected to the seal arm, wherein a locking member extends transversely from the hinge member to engage a stop on the lid housing in the first position, the locking member being moveable radially inward to disengage from the stop and to allow the seal assembly to transition from the first position to the cleaning position, wherein the drink stopper is adjacent the drink aperture and is adapted to open and close the drink aperture in the first position, wherein the drink stopper is distal the drink aperture and the drink aperture is open for cleaning the lid assembly when the seal assembly is in the second position, and wherein the drink stopper is not capable of closing the drink aperture in the second position.

19. The lid assembly of claim 18, further comprising a trigger member connected to the lid housing, wherein the trigger member is adapted to operate the drink stopper when the seal assembly is in the first position, and wherein the drink stopper cannot be operated by the trigger member when the seal assembly is in the second position.

20. The lid assembly of claim 18, wherein the hinge member has a first portion that is generally perpendicular to a longitudinal axis of the container body when the seal assembly is in the first position, and a second portion that is generally parallel to the longitudinal axis of the container body when the seal assembly is in the first position, the locking member extending from the second portion that is generally parallel to the longitudinal axis of the container body.

21. The lid assembly of claim 20, further comprising a joint between the first portion of the hinge member and the second portion of the hinge member, the joint assisting the second portion of the hinge member to be flexed radially inward upon a force applied to the second portion of the hinge member to release the locking member from the lid assembly to transition the seal assembly to the cleaning position.

* * * * *